United States Patent [19]

Mills et al.

[11] 4,299,271

[45] Nov. 10, 1981

[54] STORAGE OF RADIOACTIVE LIQUIDS

[75] Inventors: Alfred L. Mills, Thurso, Scotland; John Reekie, Culcheth; John A. Williams, Appleton, both of England

[73] Assignee: United Kingdom Atomic Energy Authority, London, England

[21] Appl. No.: 78,790

[22] Filed: Sep. 25, 1979

[30] Foreign Application Priority Data

Nov. 7, 1978 [GB] United Kingdom ..... 43505/78

[51] Int. Cl.[3] ..... G21F 9/22

[52] U.S. Cl. ..... 165/47; 165/DIG. 1; 165/DIG. 14; 165/104.25; 250/506; 252/631; 422/903

[58] Field of Search ..... 252/301.1 W; 250/506, 250/507, 517; 165/105, 47, 107, DIG. 1, DIG. 14; 422/907

[56] References Cited

U.S. PATENT DOCUMENTS

| | | | |
|---|---|---|---|
| 3,190,808 | 6/1965 | Dodd | 165/105 |
| 3,934,152 | 1/1976 | Alleaume | 250/506 |
| 4,040,480 | 8/1977 | Richards | 250/506 |

*Primary Examiner*—Deborah L. Kyle

*Attorney, Agent, or Firm*—Oblon, Fisher, Spivak, McClelland & Maier P.C.

[57] ABSTRACT

Radioactive liquids are stored in coils placed in tanks containing circulating cooling medium. The liquid in the coil is circulated by a fluidic pump. In the event of a failure in the pumps circulating the cooling medium the decay heat will cause the cooling medium to boil. A reflux condensor fitted to the tank prevents loss of cooling medium during such periods of pump malfunction.

4 Claims, 2 Drawing Figures

STORAGE OF RADIOACTIVE LIQUIDS

BACKGROUND OF THE INVENTION

This invention relates to the storage of liquid radioactive material.

The term "liquid radioactive material" as used in this specification includes within its scope solutions and slurries.

Such solutions and slurries may arise during the reprocessing of irradiated nuclear fuel. When a nuclear fuel has been irradiated in a nuclear reactor it is normally reprocessed to separate uranium and plutonium from the fission products. The fission products are highly radioactive and have to be stored for very long periods. One method for the long term storage of fission products is to store them as solutions or slurries in large tanks fitted with cooling coils to remove the decay heat and with means for circulating the fission product solution or slurry within the tank. However it is difficult to ensure that sufficient circulation occurs within the large volume of liquid in the tank to prevent the accumulation of sediment on the tank walls and on the cooling coils which tends to reduce the efficiency of the cooling. As a safety measure there must be spare tanks available to which to transfer the fission product solution or slurry should any defect become apparent in the original tank. The capital investment in such storage tanks is large and it is therefore desirable to reduce the number of spare tanks which have to be provided.

SUMMARY OF THE INVENTION

According to the present invention a storage installation for liquid radioactive material comprises pipe circuits containing the liquid radioactive material, means for circulating the liquid radioactive material around the pipe circuits and means for circulating a liquid cooling medium over the external surface of the pipe circuits.

The liquid cooling medium may be in a tank and the pipe circuits may be immersed in the cooling medium in the tank. Alternatively the liquid cooling medium may be passed through the annular gap between co-axial pipes the inner one of which contains the liquid radioactive material.

The liquid cooling medium may be circulated from the tank or the annular gap between the co-axial pipes of the alternative pipe circuits described above to a heat exchanger by means of pumps. Should the pumps cease to operate the temperature of the liquid radioactive material within the pipe circuits will rise because of the cessation of flow of the cooling medium. It is undesirable that the liquid radioactive material should boil within the pipe circuits. Additionally, as the temperature of the liquid radioactive material rises the rate of corrosion of the pipe circuits by the liquid material therein also rises. To prevent boiling of the liquid radioactive material and to minimise the corrosion which could occur during a malfunction of the cooling medium circulating pump secondary cooling systems are preferably provided.

In the case of pipe circuits which are immersed in the cooling medium in a tank a condenser may be provided on the tank to prevent loss of any cooling medium should the temperature of the cooling medium be raised to a point at which evaporation of the cooling medium is occurring to a significant extent. The condenser is preferably an air condenser requiring no power input for its operation and it should be of such a size that no loss of cooling medium occurs even if the cooling medium boils.

The said means for circulating the liquid radioactive material around the pipe circuits may comprise fluidic pump means, and such means may be operated by a pulsed-liquid column controlled by air pressure.

The cooling medium may be water but if a tank is used which is fitted with a reflux condenser as described in the preceding paragraph a cooling medium having a boiling point in the range 60°-80° C. is preferred so that the temperature of the pipe circuits does not rise to a point where the corrosion rate is excessive. Examples of cooling media which may be used include methanol, isopropanol, methylene chloride, carbon tetrachloride and other halogenated hydrocarbons such as those sold under the trade name Freon. In a situation where the pumps circulating the cooling medium are not operating the latent heat of evaporation extracted from the pipe circuits as the cooling medium boils prevents excessive heating in the pipe circuits.

DESCRIPTION OF THE DRAWINGS

The invention is illustrated by the following description of storage installations for liquid radioactive waste, given by way of example only. The description has reference to the accompanying drawings in which.

DESCRIPTION OF THE PREFERRED EMBODIMENTS

Figure 1:
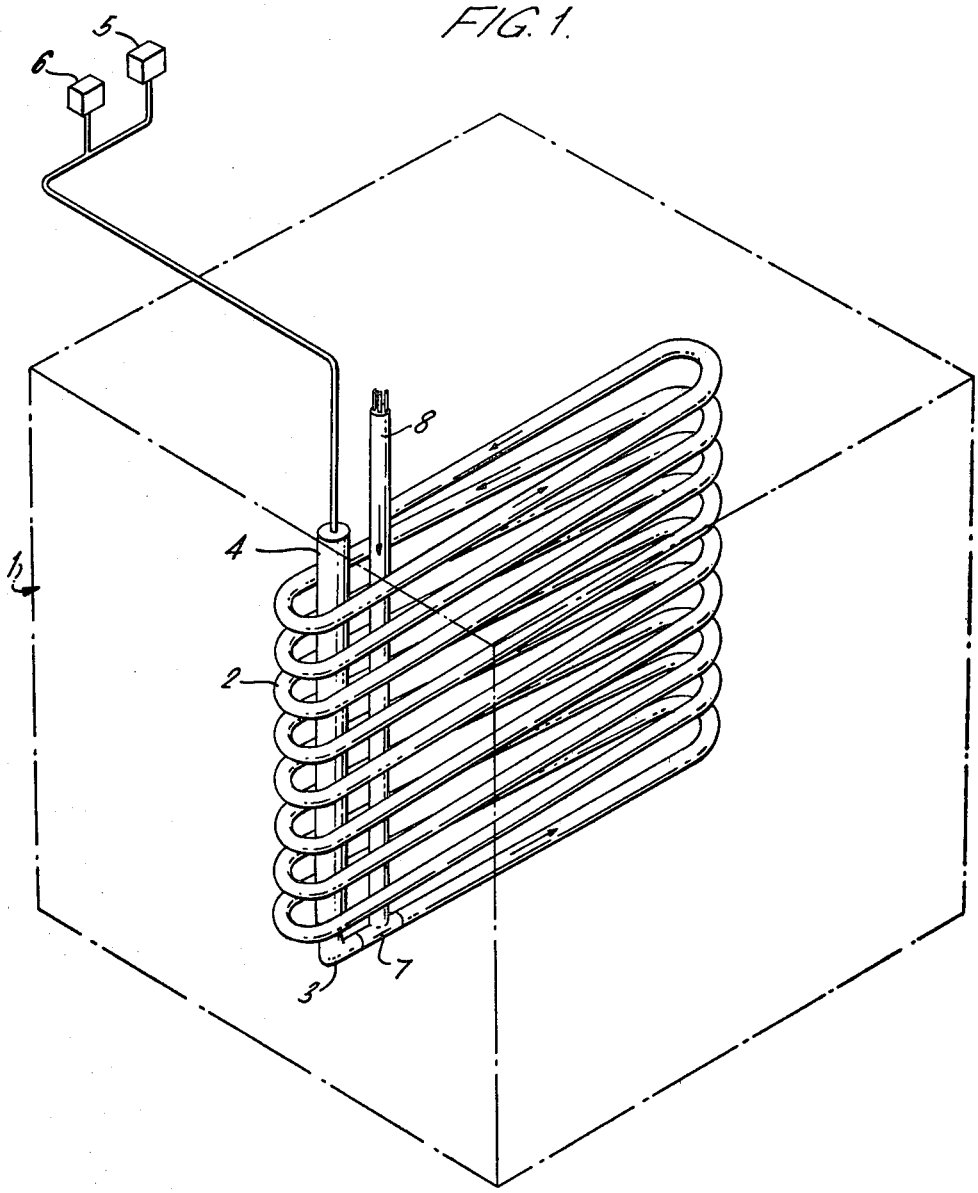
FIG. 1 is a diagrammatic representation of a storage installation for liquid radioactive waste and FIG. 2 is a diagrammatic representation of a further storage installation for liquid radioactive waste showing a cooling system for the circulating liquid cooling medium in normal operation and a secondary cooling system.

Referring to FIG. 1, the installation illustrated therein comprises a tank 1 containing a liquid cooling medium which may be water and which is circulated by pumps (not shown) through heat exchangers (not shown) to remove the decay heat of the radioactive material. Five pipe circuits 2 (of which only one is shown) are immersed side-by-side in the cooling medium in the tank 1. Each pipe circuit 2 is manufactured from seamless stainless steel tube and is provided with a side arm 3 which has a pulsing chamber 4. The liquid in the pulsing chamber is caused to oscillate by air-flow controllers 5, 6 which alternatively introduce air into the pulsing chamber 4 and withdraw it. The oscillating motion of the liquid in the pulsing chamber is converted by a fluidic pump 7 into a circulatory motion around the pipe circuit 2 in the direction of the arrows. The fluidic pump 7 operates on the pulsed fluid diode principle and has no moving parts within the tank 1. A further side arm 8 extends from the pipe circuit to a point above the liquid level in the tank and this further side arm is used for filling and emptying the pipe circuit 2, for removing samples of the liquid for analysis and for providing access for instruments to be lowered into the liquid, for example to measure the temperature of the liquid.

Conveniently the pipe circuit 2 shown in the figure may be manufactured from 10" diameter seamless stainless steel tube and may contain 450 feet of such tube. A pipe circuit so formed would have a capacity of 7 cubic meters.

The pipe circuits 2 are placed in the tank 1 in close packed array to maximise the number of pipe circuits in the tank. Pipe circuits of different shapes, sizes and pipe diameters may be utilised within a tank to maximise the utilisation of the space within the tank.

In use the fluidic pump 7 circulates the liquid radioactive material round the pipe circuit 2. This circulation minimises the possibility of sediment depositing on the walls of the coil which reduces the heat transfer properties of the walls. If water is used as the cooling medium in the tank, it is chemically treated to ensure minimum corrosion of the pipe circuits and tank. The cooling liquid is preferably monitored to detect any increase in radioactivity level which would indicate that a pipe circuit was leaking. In the event that one pipe circuit in a tank leaks only the radioactive material in that circuit has to be transferred to alternative storage facilities. Thus the amount of spare storage capacity which has to be provided is less than is required for storage in tanks. If one pipe circuit leaks the remaining pipe circuits can remain in the tank and the faulty circuit can be isolated or replaced. Thus the failure of one pipe circuit does not necessitate abandoning the tank and its associated shielding whereas a failure in the tank used for tank storage of radioactive liquids may mean that the tank and the shielding surrounding it become heavily contaminated and cannot be re-used.

An alternative embodiment may be manufactured from tubing having two co-axial tubes. The liquid radioactive material is stored in the inner tube and the cooling medium is circulated through the annular gap between the tubes. The pipe circuit formed from co-axial tubes may be placed in a tank, for example as shown in FIG. 1, and may be further cooled by the circulation of a liquid medium such as water in the tank.

Figure 2:
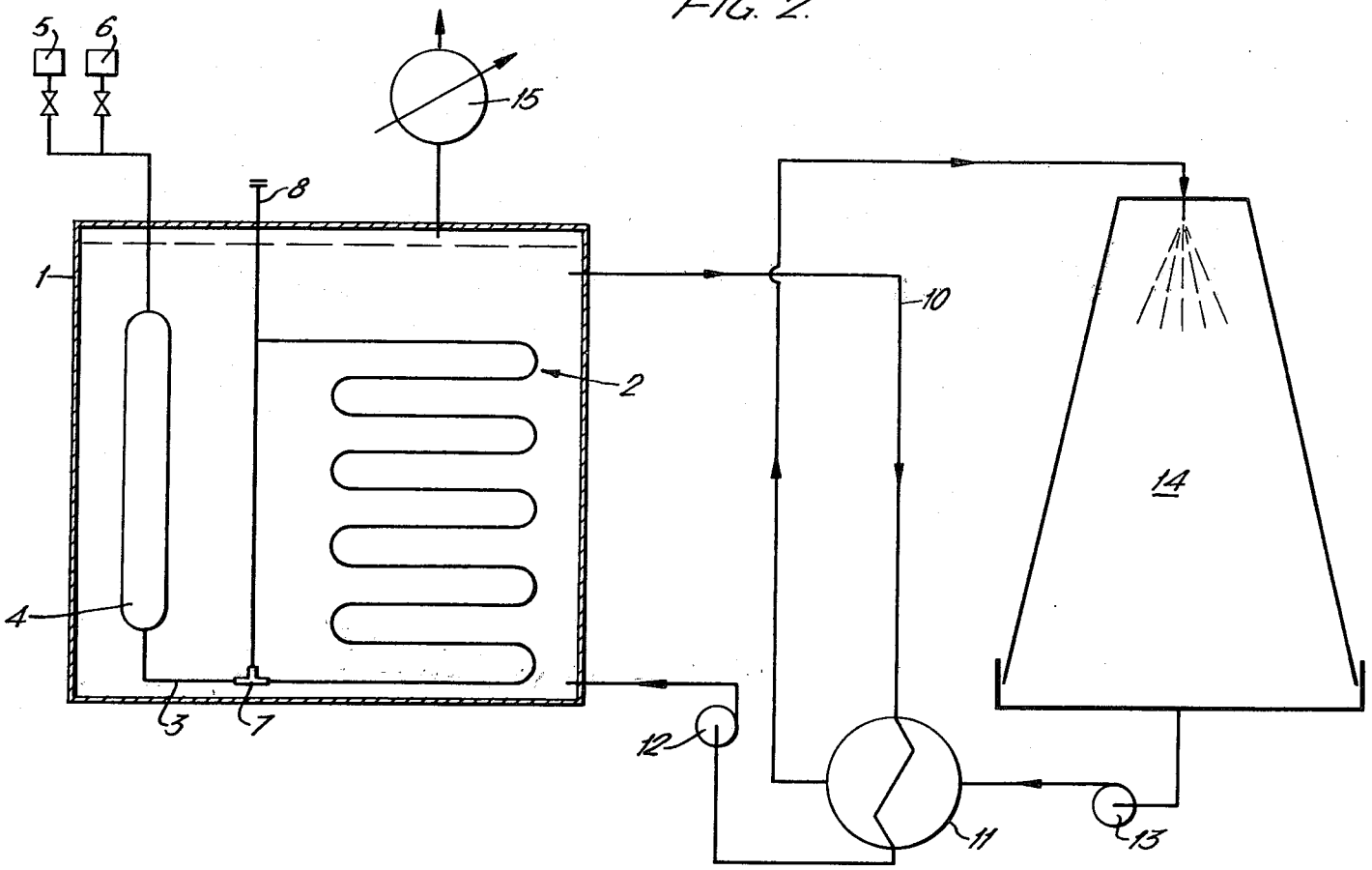

Referring now to FIG. 2 a tank 1 and a pipe circuit 2 are shown. The pipe circuit is similar to that shown in FIG. 1 and the same reference numerals are used to identify the parts thereof. In normal use the cooling medium is withdrawn from the tank 1 through a pipe 10 and passed through a heat exchanger 11 by a pump 12 and returned to the base of the tank 1. The heat exchanger is cooled by water which is circulated by a pump 13 and which is passed down a cooling tower 14. The tank 1 is fitted with an air-cooled condenser 15 to condense any vapour evaporating from the cooling medium and return it to the tank.

In the event of a malfunction of any of the components of the cooling system which prevent or reduce the circulation of the cooling medium the decay heat emitted by the liquid radioactive material in the pipe circuit 2 will raise the temperature of the liquid material in the pipe circuit and of the cooling medium in the tank. If the rise in temperature proceeds for a sufficient length of time the temperature of the cooling medium will rise to its boiling point. The cooling medium then boils and the vapour condenses in the condenser 15 and is returned to the tank 1. As the liquid medium boils, its latent heat of evaporation is extracted from the pipe circuits and the temperature in the pipe circuits will be maintained at a value similar to the boiling point of the medium. The use of a cooling medium having a boiling point in the range 60°–80° C. ensures that the temperature within the pipe circuits does not rise to the boiling point of the liquid radioactive material or to a point where the corrosion rate of the pipe circuits by the liquid radioactive material becomes excessive. In normal use the circulating cooling medium ensures that the temperature of the liquid radioactive material is kept as low as possible and it is only in the situation where the normal circulatory cooling is not operative that the secondary cooling system utilising the condenser 15 is operative.

The cooling medium surrounding the pipe circuits in the present invention acts as an additional barrier facilitating the containment of any leakage which may occur from the pipe circuits. Storage in the pipe circuits rather than in tanks facilitates criticality control of liquids containing plutonium as the pipe circuits can be designed to be safe by geometry. The construction of storage installations according to the present invention is facilitated as the pipe circuits can be tested before being installed. The circulation of the liquid radioactive material and of the cooling medium and the large surface area of the pipe circuits facilitates heat transfer from the liquid radioactive material to the cooling medium.

We claim:

1. A storage installation for liquid radioactive material comprising:

a tank for a liquid coolant;

at least one pipe circuit containing liquid radioactive material immersed in the coolant;

pulsed fluidic pump means in the pipe circuit for circulating the radioactive material around the pipe circuit to minimize the accumulation of sediment therein; and means for circulating the liquid coolant around the pipe circuit.

2. A storage installation according to claim 1 in which said means for circulating the liquid coolant comprises:

a pump, and a heat exchanger disposed outside the tank.

3. A storage installation according to claim 1, further comprising:

the liquid coolant having a boiling point less than the boiling point of the liquid radioactive material in the pipe circuit; and an air condenser in communication with the interior of the tank provided for condensing coolant vapor from the tank and for returning condensate to the tank.

4. A storage installation for liquid radioactive material comprising:

a first pipe circuit for circulating a liquid coolant, a second pipe circuit concentric with said first pipe circuit for containing liquid radioactive material, pulsed fluidic pump means in the pipe circuit for circulating the radioactive material around the second pipe circuit to minimize the accumulation of sediment therein; and means for circulating the liquid coolant around the first pipe circuit.

* * * * *